US005706678A

United States Patent [19]

Sasaki

[11] Patent Number: 5,706,678

[45] Date of Patent: Jan. 13, 1998

[54] LAUNDRY DRESSER

[75] Inventor: Akihiro Sasaki, Sagaminara, Japan

[73] Assignee: Meico Enterprise Co., Ltd., Tokyo, Japan

[21] Appl. No.: 615,827

[22] Filed: Mar. 14, 1996

[30] Foreign Application Priority Data

Mar. 17, 1995 [JP] Japan ..... 7-002056 U
Mar. 17, 1995 [JP] Japan ..... 7-058559

[51] Int. Cl.[6] ..... D06F 29/00

[52] U.S. Cl. ..... 68/13 R; 4/638; 68/208; 312/228

[58] Field of Search ..... 68/3 R, 13 R, 68/208; 134/115 R; 312/228, 229; 4/638

[56] References Cited

U.S. PATENT DOCUMENTS

| | | | |
|---|---|---|---|
| 2,256,425 | 9/1941 | Damiano | 68/13 R X |
| 2,370,498 | 2/1945 | Sheerin | 4/638 X |
| 2,579,393 | 12/1951 | Modrey | 68/13 R X |
| 2,603,097 | 7/1952 | Kelley et al. | 68/13 R X |
| 2,813,534 | 11/1957 | Low | 4/638 X |
| 3,331,226 | 7/1967 | Fink | 68/13 R X |
| 4,186,770 | 2/1980 | Zijlstra . | |
| 4,739,781 | 4/1988 | Casoli | 312/228 X |
| 5,404,895 | 4/1995 | Yamauchi et al. | 312/228 X |

FOREIGN PATENT DOCUMENTS

3409972 A1 9/1985 Germany .

*Primary Examiner*—Philip R. Coe
*Attorney, Agent, or Firm*—Finnegan, Henderson, Farabow, Garrett & Dunner

[57] ABSTRACT

The laundry dresser includes (a) a dresser frame having two segments arranged horizontally; (b) a flat table plate extending horizontally over the two segments; (c) a hollow portion disposed in a first segment beneath the table plate for receiving a drum rotation-type washing machine; (d) a washbowl mounted to the dresser frame; and (e) a drain pipe having (i) an upright portion rotatable around a vertical axis thereof, and (ii) a slightly slanting, horizontal portion connected to a lower end of the upright portion and having an exit opening at a lower end thereof, the direction and length of the horizontal portion being determined such that the exit opening of the horizontal portion is fitted into a drain opening of a floor, the drain pipe receiving a drain hose of the washing machine and a drain hose of the washbowl through the upper opening to allow drainage from the washing machine and the washbowl to flow into the drain opening.

12 Claims, 6 Drawing Sheets

LAUNDRY DRESSER

BACKGROUND OF THE INVENTION

The present invention relates to a laundry dresser having a washbowl and a drum rotation-type washing machine which can be installed at any desired place of a floor not restricted by the position of a drain opening.

A dresser and a washing machine have conventionally been installed separately in the same or different rooms in many houses and apartments. However, since they are usually used in a bathroom, it would be convenient to combine them into a single furniture. Such combination is usually called "laundry dresser." When the laundry dresser is installed in a bathroom, for instance, it is placed at a location determined by the position of a drain opening provided on a floor. From the standpoint of convenience and interior decoration, however, many customers want to install the laundry dresser wherever they prefer, and conventional laundry dressers fail to meet such demands. This is because the conventional laundry dressers should be placed such that their drain pipes which are fixed to their frames are positioned substantially immediately above drain opening on a floor.

In addition to the contribution of a combination of a dresser and a washing machine to saving a room space, the overall design of a laundry dresser as an interior furniture and the convenience thereof as a utility facility are important. First, a table plate of the laundry dresser extending from a washbowl region to a washing machine region is preferably flat, because users would feel uncomfortable in appearance and convenience if the table plate has a step between the washbowl region and the washing machine region. However, such structural requirements may make the positioning of a washing machine difficult in some cases, because some washing machines may not be small enough to be accommodated or built in a space under a table plate. Also, the washing machine is inevitably a drum rotation-type one having a drum which rotates around a horizontal axis to wash and dry materials such as clothing, etc. (hereinafter referred to as "wash") and has an opening on a front surface of the washing machine with a water-tightly sealable lid which is openable horizontally, because of the existence of a table plate covering the washing machine. Thus, the washing machine should easily be able to be built in the laundry dresser at the time of installation, and also should easily be able to be withdrawn therefrom for inspection and repair whenever necessary.

At the same time, since the drum rotation-type washing machine is prone to vibrate at the time of washing operation under improper positioning conditions, it tends to move on a floor if its support legs are not fixed to the floor. However, the fixing of the support legs of the drum rotation-type washing machine to the floor is impossible in the laundry dresser, because the drum rotation-type washing machine should easily be able to be built in the laundry dresser after the laundry dresser is installed on the floor and also should easily be able to be withdrawn therefrom whenever inspection and repair are necessary. Accordingly, the laundry dresser should have a means for fixedly positioning the drum rotation-type washing machine in a space under the table plate.

Further, since the table plate of the laundry dresser, which is substantially flat from the washbowl region to the washing machine region, should be high enough to accommodate a regular drum rotation-type washing machine in a space thereunder, some of little children and women may feel that the table plate is too high. In such a case, the laundry dresser should have a means for making up for the shortage of their height.

OBJECTS AND SUMMARY OF THE INVENTION

Accordingly, an object of the present invention is to provide a laundry dresser which can be installed in any place not restricted by a position of a drain opening provided in a floor.

Another object of the present invention is to provide a laundry dresser comprising a drum rotation-type washing machine which can easily be built in and withdrawn from the laundry dresser whenever inspection or repair is necessary.

A further object of the present invention is to provide a laundry dresser which a person of any height can use comfortably.

As a result of research in view of the above objects, it has been found that by shaping a drain pipe for receiving drainage from a washbowl and a washing machine and discharging it to a drain opening on a floor to have a substantially upright portion having an upper opening for receiving drain hoses of the washbowl and the washing machine and being rotatable around a vertical axis thereof, and a slightly slanting, substantially horizontal portion connected to a lower end of the upright portion and having an exit opening at a lower end thereof, and by making the direction and length of the slightly slanting, substantially horizontal portion adjustable such that the exit opening of the horizontal portion is fitted into a drain opening of a floor, it is possible to install the laundry dresser in any desired place of a floor as long as the laundry dresser covers the drain opening, and to have a wide space in the laundry dresser above the drain pipe, which can contain the wash, etc.

Thus, the laundry dresser according to the present invention comprises;

(a) a substantially integral dresser frame having at least two segments arranged horizontally;

(b) a substantially flat table plate extending horizontally over at least two segments;

(c) a hollow portion disposed in a first segment beneath the table plate for receiving a drum rotation-type washing machine;

(d) a washbowl integrally mounted to the dresser frame with its upper fringe substantially co-planar with the table plate in a second segment; and (e) a drain pipe having (i) a substantially upright portion having an upper opening and being rotatable around a vertical axis thereof, and (ii) a slightly slanting, substantially horizontal portion connected to a lower end of the upright portion and having an exit opening at a lower end thereof, the direction and length of the horizontal portion being determined such that the exit opening of the slightly slanting, substantially horizontal portion is fitted into a drain opening of a floor, the drain pipe receiving a drain hose of the washing machine and a drain hose of the washbowl through the upper opening to allow drainage from the washing machine and the washbowl to flow into the drain opening.

BRIEF DESCRIPTION OF THE DRAWINGS

FIG. 4(*b*) is a plan view showing the drain pipe which is cut to such a length as to fit the drain opening;

FIG. 4(*c*) is a plan view showing the drain pipe which is fitted into the drain opening;

FIG. 5(*b*) is a cross-sectional view taken along the line 5B—5B in FIG. 5(*a*);

FIG. 6(*b*) is a cross-sectional view taken along the line 6B—6B in FIG. 6(*a*);

DETAILED DESCRIPTION OF THE PREFERRED EMBODIMENTS

Figure 1:
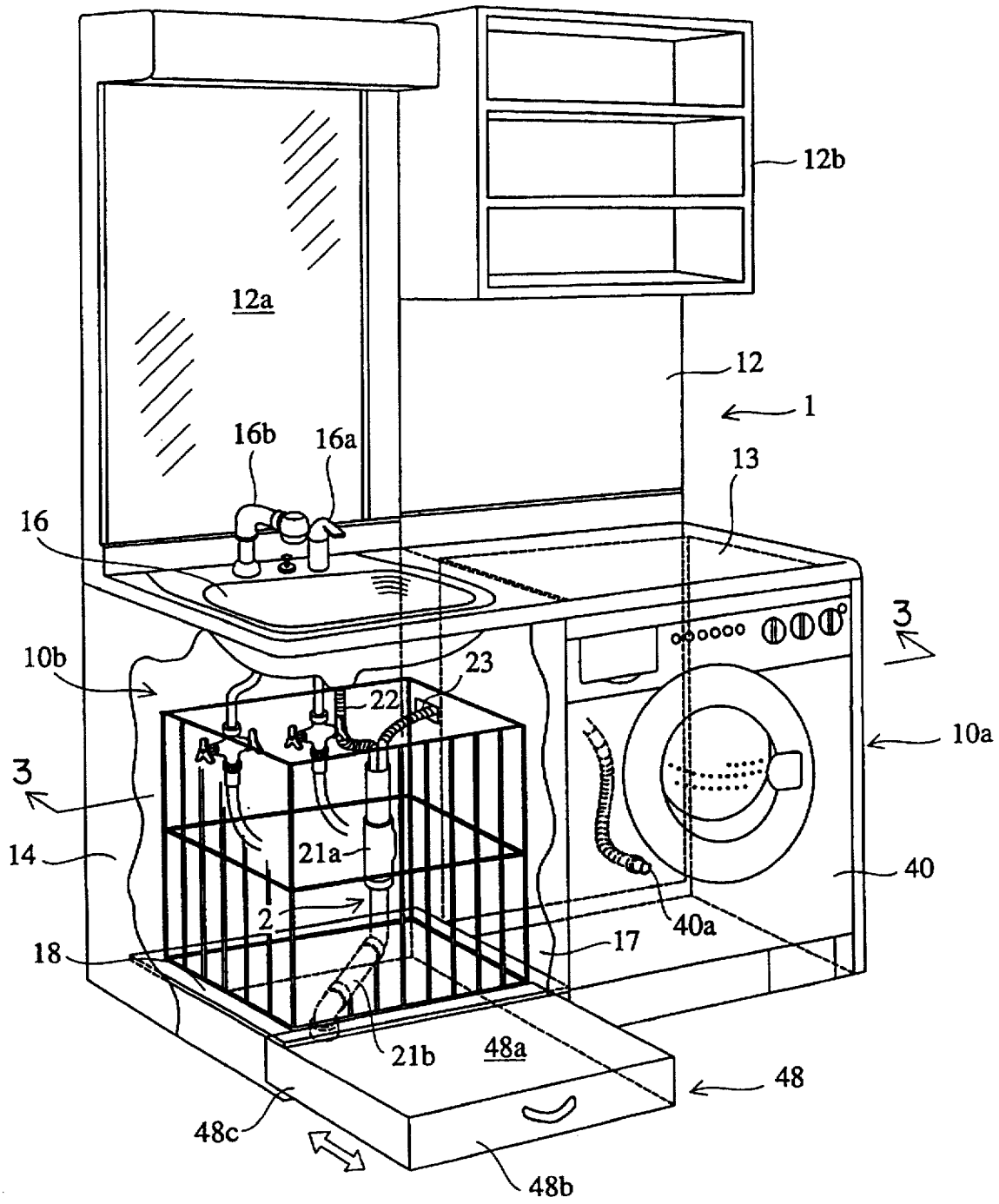
FIG. 1 is a partially broken perspective view showing a laundry dresser according to one embodiment of the present invention.
Figure 2:
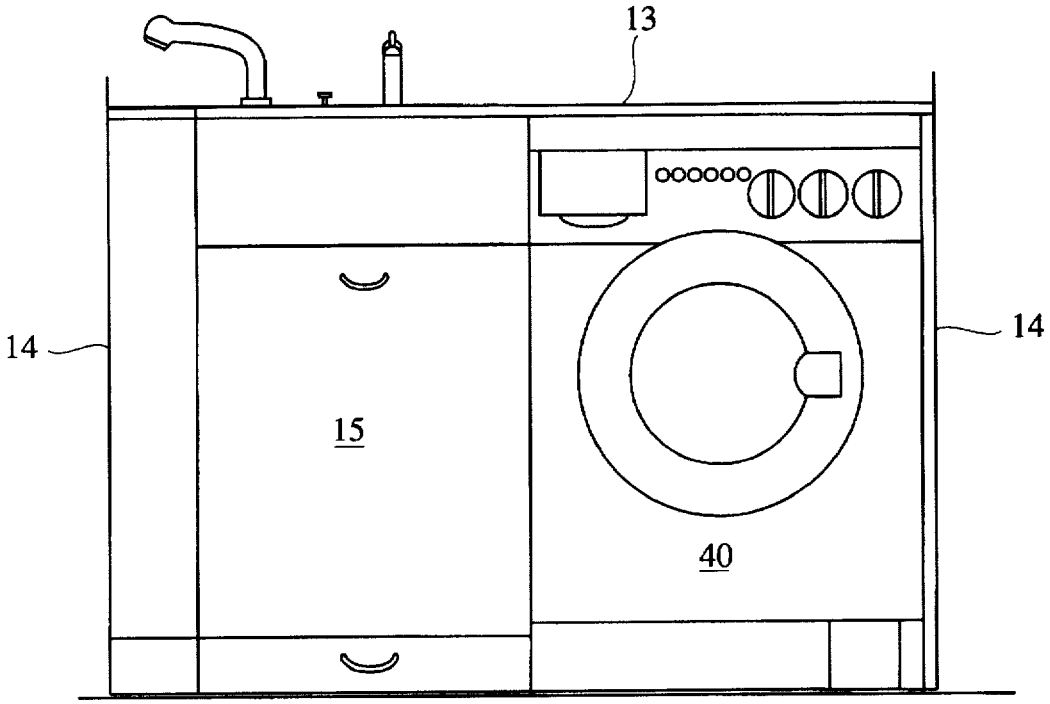
FIG. 2 is a partial front view of the laundry dresser.
Figure 3:
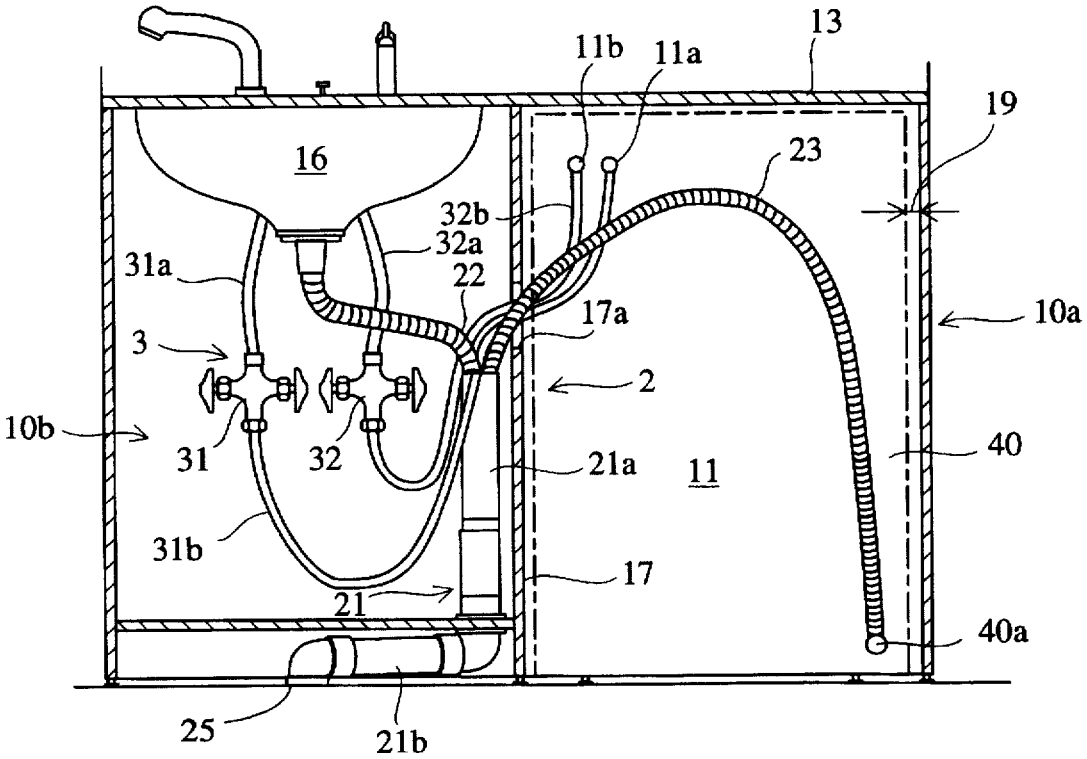
FIG. 3 is a partial cross-sectional view taken along the line 3—3 in FIG. 1.

The laundry dresser according to one embodiment of the present invention is exemplified in FIGS. 1–3. The laundry dresser comprises a dresser frame 1 having a first segment 10*a* having a hollow portion 11 and a second segment 10*b* in which a washbowl 16 and a drain system 2 are installed.

The dresser frame 1 is constituted by a rear upright wall 12 horizontally extending between right and left sides and upwardly extending from upper surfaces of the first and second segments 10*a*, 10*b* for supporting a mirror 12*a* and a shelf 12*b*, a substantially flat table plate 13 horizontally extending between right and left sides over the first segment 10*a* and the second segment 10*b*, right and left side walls 14 extending from the table plate 13 to the bottom of the dresser frame 1, a front door 15 mounted to the dresser frame 1 in the second segment 10*b*, and a partition plate 17 vertically extending and fixed to the dresser frame 1 between the first segment 10*a* and the second segment 10*b* and having an opening 17*a* near a rear wall of the dresser 1. The dresser frame 1 further comprises a horizontal plate or raised bottom plate 18 fixed to the side wall 14 and the partition plate 17 at such a small height that a space defined by the horizontal plate 18, the side wall 14 and the partition plate 17 can accommodate the horizontal portion 21*b* of the drain pipe 21 as described in detail below. Integrally mounted to the table plate 13 over the second segment 10*b* is a washbowl 16 with its upper fringe substantially co-planar with an upper surface of the table plate 13. The washbowl 16 may have a tap 16*a*, a shower 16*b* and other attachments (not shown).

A drum rotation-type washing machine 40 is installed in the hollow portion 11 of the dresser frame 1 in the first segment 10*a* with a clearance 19 between an outer surface of the drum rotation-type washing machine 40 and the inner surface of the hollow portion 11.

As is apparent from FIGS. 1 and 3, a drain system 2 comprises a drain pipe 21 comprising an upright portion 21*a* and a slightly slanting, substantially horizontal portion (simply called "horizontal portion") 21*b* connected to a lower end of the upright portion 21*a* and extending to a drain opening 25 at a lower end thereof, a drain hose 22 having an upper end connected to a lower opening of the washbowl 16 and a lower end inserted into the upright portion 21*a* of the drain pipe 21, and a drain hose 23 having one end fitted to a drain opening 40*a* of the drum rotation-type washing machine 40 and the other end inserted into the upright portion 21*a* of the drain pipe 21. The drain pipe 21 may be made of plastics such as polyvinyl chloride which are durable and easy to work. There is a pump (not shown) mounted to the washing machine 40 for forcing drainage from the washing machine 40 to flow through the drain hose 23 into the drain pipe 21. The drain hose 23 may pass through the hole 17*a*.

A water supply system 3 installed in the second segment 10*b* comprises a water valve 31 to which a hose 31*a* leading to a mixer (not shown) connected to the tap 16*a* and the shower 16*b* and a hose 31*b* leading to a water inlet 11*a* of the drum rotation-type washing machine 40 are connected, and a hotwater valve 32 to which a hose 32*a* leading to the mixer connected to the tap 16*a* and the shower 16*b* and a hose 31*b* leading to a hot-water inlet 11*b* of the drum rotation-type washing machine 40 are connected. The temperature of water flowing from the tap 16*a* and the shower 16*b* is controlled by the mixer for adjusting the flow rates of water and hot water supplied through the hoses 31*a*, 32*a*. The hoses 31*b*, 32*b* pass through a hole 17*a* of the partition plate 17. The valves 31, 32 pass through the rear wall of the dresser frame 1 and are connected to pipes 35*a*, 35*b* which are in turn connected to sources (not shown).

Figure 5:
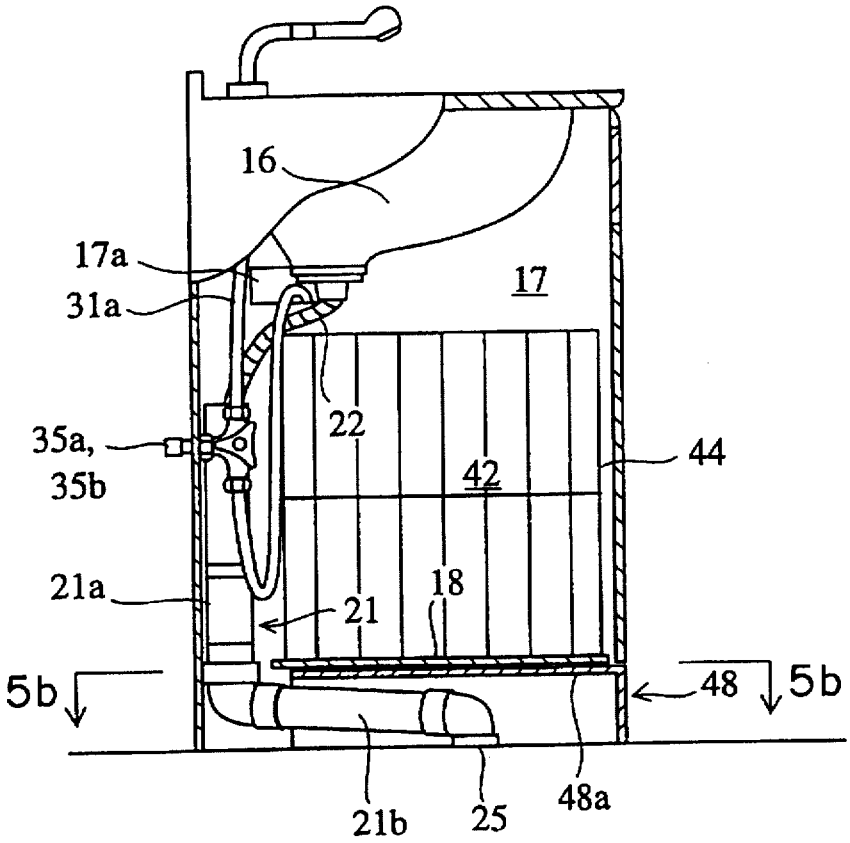
FIG. 5(*a*) is a partially broken left side view of the laundry dresser in which a footstool is fitted under the laundry dresser.
Figure 5:
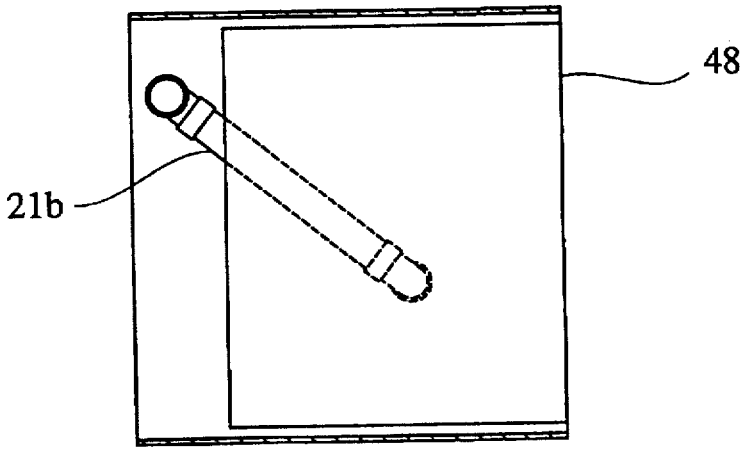

As is apparent from FIGS. 1 and 5(*a*), since the horizontal portion 21*b* of the drain pipe 21 extends under the horizontal plate 18, and since the upright portion 21*a* of the drain pipe 21 and the water supply system 3 are positioned near the upright wall 12, the second segment 10*b* provides a large space 42 in which a cage 44 for the wash, etc. may be placed. For the purpose of inspection or repair of the drain pipe 21, it is preferable that the horizontal plate 18 is detachable from the dresser, which can be achieved by a known means (not shown).

Figure 4:
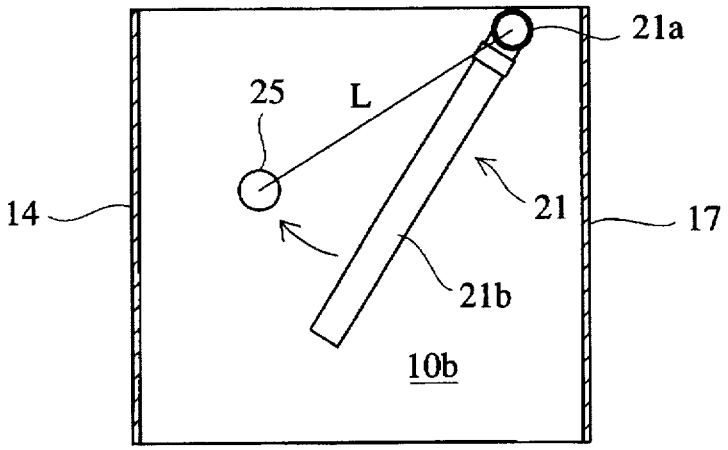
FIG. 4(*a*) is a plan view showing the drain pipe before cut to a proper length.
Figure 4:
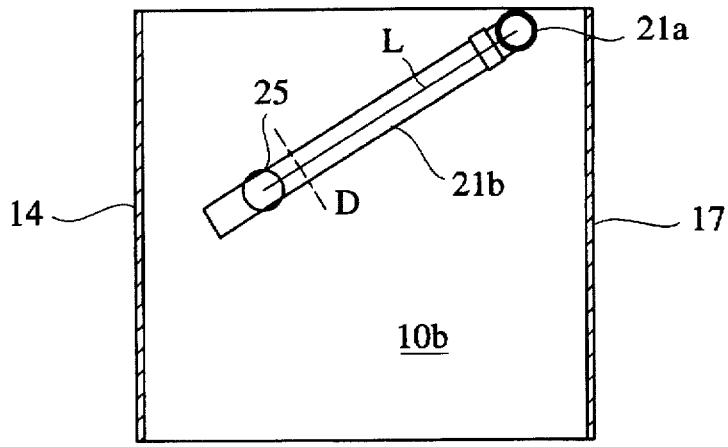
Figure 4:
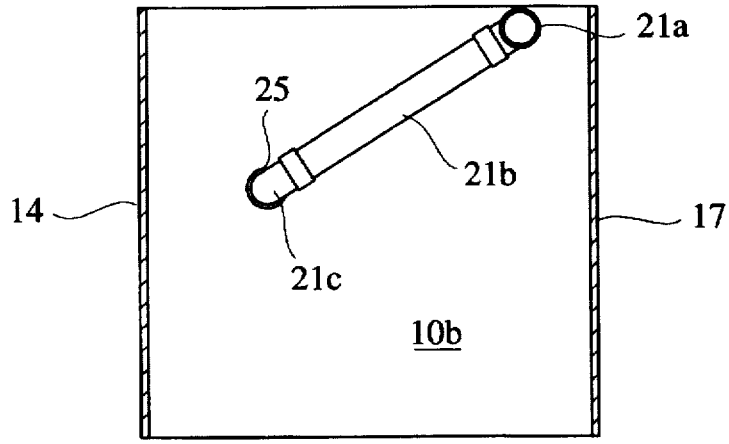

FIGS. 4(*a*)–(*b*) show how the configuration of the drain pipe 21 is determined depending on the position of a drain opening 25 on a floor. First, the laundry dresser 1 is placed at such a position that the drain opening 25 is exposed to the second segment 10*b* as shown in FIG. 4(*a*). The upright portion 21*a* of the drain pipe 21 is rotatable around a vertical axis thereof. The length of the horizontal portion 21*b* of the drain pipe 21 is determined such that a circle made by the rotation of the horizontal portion 21*b* can cover the drain opening 25. Second, the horizontal portion 21*b* is turned to a direction of a line L connecting a vertical axis of the upright portion 21*a* and a center of the drain opening 25 as shown in FIG. 4(*b*). The horizontal portion 21*b* is cut at a length slightly shorter than the line L, as shown by the line D in FIG. 4(*b*). Finally, a bent pipe 21*c* is fixed to the end of the horizontal portion 21*b*, and a lower end of the bent pipe 21*c* is fitted into the drain opening 25 as shown in FIG. 4(*c*). Because of this configuration of the drain pipe 21, the versatility of positioning the laundry dresser has greatly increased. As a result, a customer can install the laundry dresser at such a position with which the customer is satisfied from his or her preference of interior design.

Particularly in the case of reform, it is not necessary to know in advance where there is a drain opening of a floor under the existing laundry dresser, because of the above versatility of positioning. Also, the new location of the laundry dresser is advantageously not restricted by the position of the drain opening. Since the working of the drain pipe 21 is easily carried out, no skilled worker is required.

Figure 6:
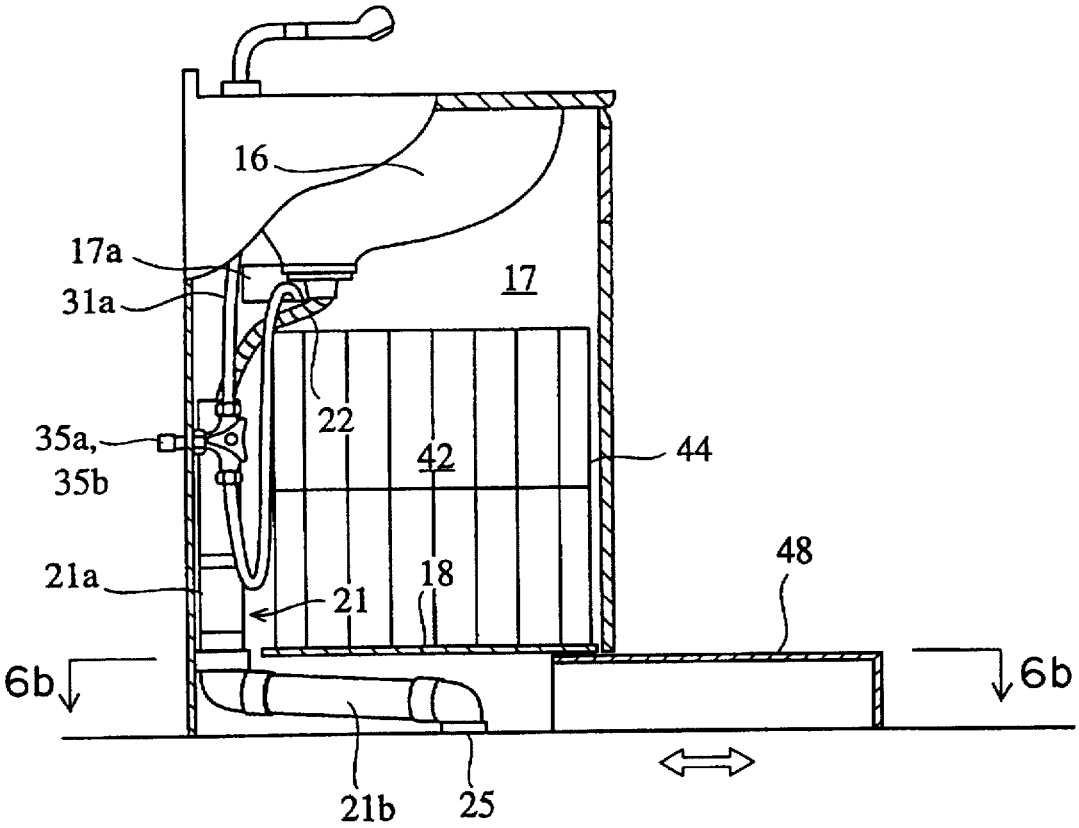
FIG. 6(*a*) is a partially broken left side view of the laundry dresser in which the footstool is withdrawn.
Figure 6:
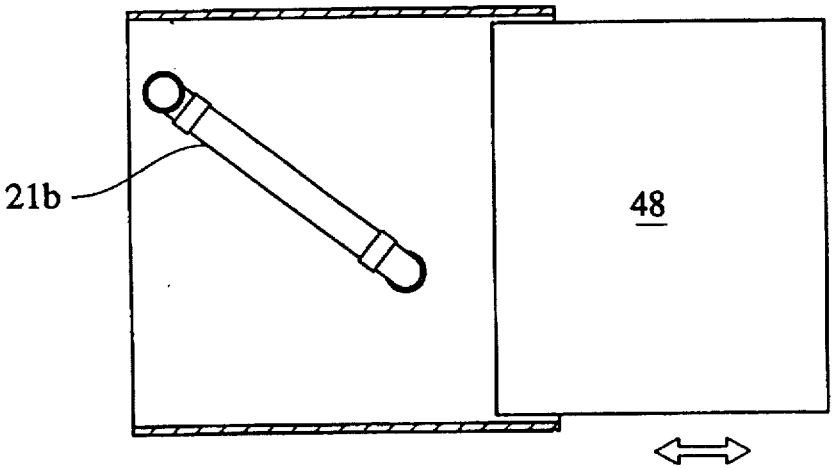

When a child or a short person uses the dresser, he or her may not be able to reach the washbowl 16 and the tap 16*a*, etc. without difficulty. In such a case, he or she can use a footstool 48 which is slidable back and forth on a floor and received in a space under the horizontal plate 18. As shown in FIGS. 1 and 5, the footstool 48 has a box shape slightly shorter than the height of the horizontal plate 18 and slightly narrower than the width of the second segment 10*b* and composed of an upper plate 48*a*, a front plate 48*b* and side plates 48*c*, having a reversed U-shaped cross section. It is shown in FIGS. 5(*a*) and 5(*b*) that the upper plate 48*a* is positioned between the horizontal plate 18 and the horizontal portion 21*b* of he drain pipe 21 when the footstool 48 is inserted into the space under the horizontal plate 18. The state of the footstool 48 withdrawn from the laundry dresser is shown in FIGS. 6(*a*) and 6(*b*).

When the drum rotation-type washing machine 40 installed in a hollow portion 11 of the first segment 10*a* of the laundry dresser is operated, a clearance 19 should exist between the inner wall of the first segment 10*a* and the outer surface of the washing machine 40, such that a vibrating drum rotation-type washing machine 40 does not come into contact with the inner wall of the first segment 10*a*. For this purpose, the drum rotation-type washing machine 40 should be kept at an initial position even when it is largely vibrated during operation. The position of the drum rotation-type washing machine 40 is kept by means of a positioning plate 50 as exemplified in FIG. 7.

Figure 7:
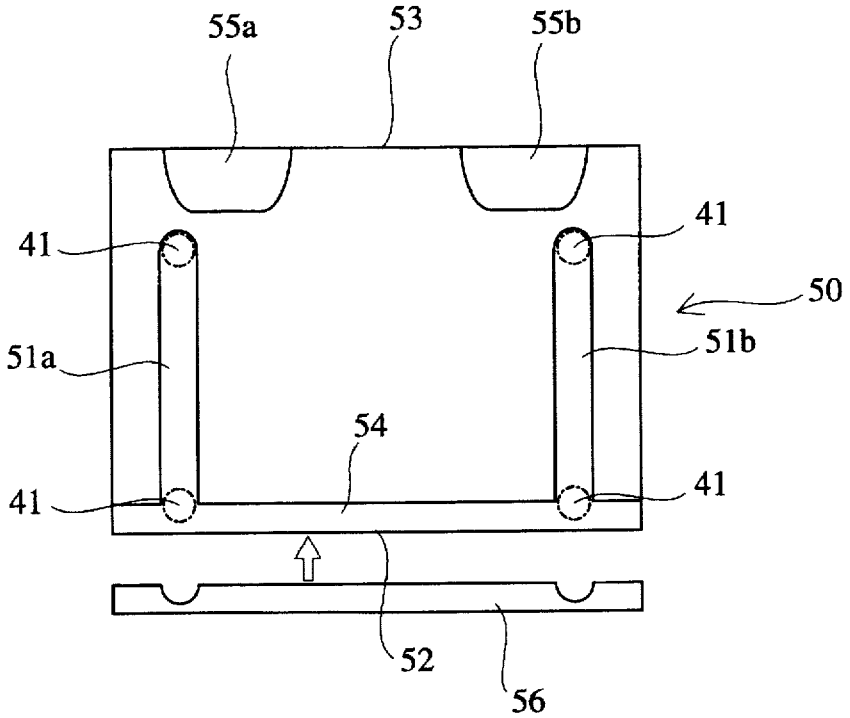
FIG. 7 is a plan view of the positioning plate on which the drum rotation-type washing machine is placed and slidable.

The positioning plate 50 comprises two grooves 51*a*, 51*b* each extending from a front end 52 to a point near a rear end 53 in a depth direction, a lateral recess 54 extending alongside the front end 52, and two notches 55*a*, 55*b* each located at the rear end 53. The depth of the grooves 51*a*, 51*b* and the lateral recess 54 is slightly larger than the height of support legs 41 of the drum rotation-type washing machine 40 so that the support legs 41 can smoothly slide back and forth in the grooves 51*a*, 51*b*. The width of the grooves 51*a*, 51*b* should be slightly larger than the diameter of the support legs 41 to such an extent that the drum rotation-type washing machine 40 does not come into contact with the inner wall of the hollow portion of the first segment 10*a* even when the drum rotation-type washing machine 40 vibrates during operation. With such a structure of the positioning plate 50, when the drum rotation-type washing machine 40 is fully inserted into the hollow portion 11 of the first segment 10*a*, the support legs 41 are positioned as shown in FIG. 7. If necessary, a stopper plate 56 may be combined with the positioning plate 50. With the support legs 41 positioned in the grooves 51*a*, 51*b*, the drum rotation-type washing machine 40 does not move during operation.

The notches 55*a*, 55*b* serve as holes through which water supply pipes and drain hoses pass. The shapes and positions of the grooves 51*a*, 51*b* and the notches 55*a*, 55*b* may be changed depending on the design of the drum rotation-type washing machine 40.

Figure 8:
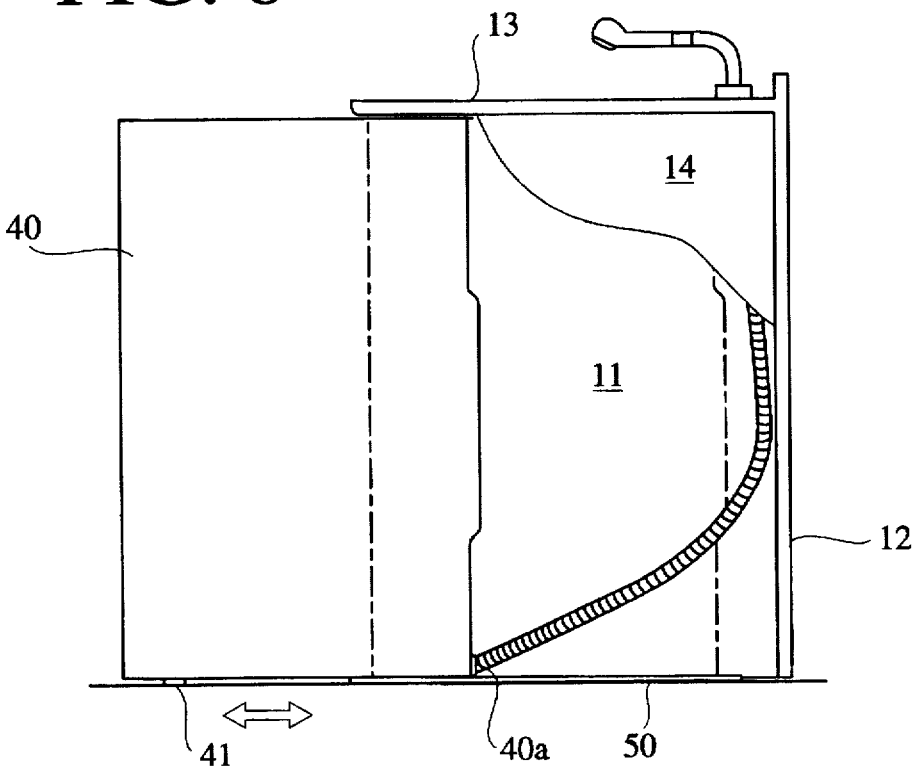
FIG. 8 is a partially broken right side view of the laundry dresser in which the drum rotation-type washing machine is partly withdrawn from the laundry dresser.

FIG. 8 shows a state in which the drum rotation-type washing machine 40 is slidably built in and withdrawn from the laundry dresser. Because the positioning plate 50 is made of a low-friction material, for example, plastics such as polyesters, nylons, etc., the support legs 41 of the drum rotation-type washing machine 40 are easily slidable through the grooves 51*a*, 51*b* of the positioning plate 50. Also, because of the lateral sliding system, the withdrawal and insertion of the drum rotation-type washing machine 40 is easily carried out.

Though the present invention has been described referring to the drawings attached hereto, it should be noted that any modifications and additions may be made to the laundry dresser of the present invention unless they deviate from the scope of the present invention defined in the claims attached hereto. For instance, the laundry dresser may have three or more segments, if desired, though the two segments are described above referring to the drawings.

The term "substantially flat table plate" does not mean that the table plate is completely flat, but means that the table plate may locally have a small step on an upper surface if such a step is desirable. For instance, there may be a small step around the upper fringe of the washbowl. In such a case, it may be said that the upper fringe of the washbowl is substantially co-planar with the table plate. Since there is no substantial step between the first and second segments, customers can comfortably use the table plate for various purposes.

Though the drain pipe and hoses described above do not have traps, it should be noted that a trap may be attached to any of the drain pipe and hoses if necessary. Instead of the trap, a filter may be equipped to the drain pipe and hoses.

What is claimed is:

1. A laundry dresser comprising;

(a) a substantially integral dresser frame having at least two segments arranged horizontally;

(b) a substantially flat table plate extending horizontally over said at least two segments;

(c) a hollow portion disposed in a first segment beneath said table plate for receiving a drum rotation-type washing machine;

(d) a washbowl integrally mounted to said dresser frame with its upper fringe substantially co-planar with said table plate in a second segment; and (e) a drain pipe having (i) a substantially upright portion having an upper opening and being rotatable around a vertical axis thereof, and (ii) a slightly slanting, substantially horizontal portion connected to a lower end of said upright portion and extending to a drain opening at a lower end thereof, the direction and length of said horizontal portion being determined such that said exit opening of said horizontal portion is fitted into a drain opening of a floor, said drain pipe receiving a drain hose of said washing machine and a drain hose of said washbowl through said upper opening to allow drainage from said washing machine and said washbowl to flow into said drain opening.

2. The laundry dresser according to claim 1, wherein said first segment comprises a positioning plate lying on a floor in said first segment, said positioning plate having grooves for receiving support legs of said washing machine and extending from a front end to a point near a rear end in a depth direction, whereby the support legs of said washing machine are slidable through said grooves to a position at which said washing machine is secured.

3. The laundry dresser according to claim 2, further comprising a stopper plate disposed at a front end of said positioning plate for keeping the support legs of said washing machine from moving from the position at which said washing machine is secured.

4. The laundry dresser according to claim 3, wherein said dresser frame has a bottom plate raised from a floor surface and extends rearward with a space between a rear end of said raised bottom plate and a rear upright plate of said dresser frame in said second segment, such that said upright portion of said drain pipe is disposed in said space and that said horizontal portion of said drain pipe extends under said raised bottom plate.

5. The laundry dresser according to claim 4, further comprising a footstool composed of an upper plate, a front plate and side plates, said footstool being configured such that it is movable back and forth on a floor under said raised bottom plate, said upper plate of said footstool being inserted into a space between said raised bottom plate and said horizontal portion of said drain pipe when fitted under said raised bottom plate.

6. The laundry dresser according to claim 5, further comprising a cage received in a space between said wash-bowl and said raised bottom plate in said second segment.

7. The laundry dresser according to claim 2, wherein said dresser frame has a bottom plate raised from a floor surface and extends rearward with a space between a rear end of said raised bottom plate and a rear upright plate of said dresser frame in said second segment, such that said upright portion of said drain pipe is disposed in said space and that said horizontal portion of said drain pipe extends under said raised bottom plate.

8. The laundry dresser according to claim 7, further comprising a footstool composed of an upper plate, a front plate and side plates, said footstool being configured such that it is movable back and forth on a floor under said raised bottom plate, said upper plate of said footstool being inserted into a space between said raised bottom plate and said horizontal portion of said drain pipe when fitted under said raised bottom plate.

9. The laundry dresser according to claim 8, further comprising a cage received in a space between said wash-bowl and said raised bottom plate in said second segment.

10. The laundry dresser according to claim 1, wherein said dresser frame has a bottom plate raised from a floor surface and extends rearward with a space between a rear end of said raised bottom plate and a rear upright plate of said dresser frame in said second segment, such that said upright portion of said drain pipe is disposed in said space and that said horizontal portion of said drain pipe extends under said raised bottom plate.

11. The laundry dresser according to claim 10, further comprising a footstool composed of an upper plate, a front plate and side plates, said footstool being configured such that it is movable back and forth on a floor under said raised bottom plate, said upper plate of said footstool being inserted into a space between said raised bottom plate and said horizontal portion of said drain pipe when fitted under said raised bottom plate.

12. The laundry dresser according to claim 11, further comprising a cage received in a space between said wash-bowl and said raised bottom plate in said second segment.

* * * * *